US007963009B2

(12) United States Patent
Tamura

(10) Patent No.: US 7,963,009 B2
(45) Date of Patent: Jun. 21, 2011

(54) SLIDE FASTENER TOP END STOP

(75) Inventor: Kazuo Tamura, Toyama-ken (JP)

(73) Assignee: YKK Corporation (JP)

( * ) Notice: Subject to any disclaimer, the term of this patent is extended or adjusted under 35 U.S.C. 154(b) by 822 days.

(21) Appl. No.: 11/953,979

(22) Filed: Dec. 11, 2007

(65) Prior Publication Data

US 2008/0155797 A1 Jul. 3, 2008

(30) Foreign Application Priority Data

Dec. 28, 2006 (JP) ..... 2006-355718

(51) Int. Cl.
*A44B 19/36* (2006.01)
*A44B 19/24* (2006.01)

(52) U.S. Cl. ..... 24/436; 24/388

(58) Field of Classification Search ..... 24/409, 24/436, 387, 388
See application file for complete search history.

(56) References Cited

U.S. PATENT DOCUMENTS

| | | | | |
|---|---|---|---|---|
| 3,906,594 | A * | 9/1975 | Takahashi et al. | 24/436 |
| 3,959,858 | A * | 6/1976 | Fukuroi | 24/435 |
| 4,034,445 | A | 7/1977 | Stephens | |
| 4,223,425 | A * | 9/1980 | Akashi | 24/388 |
| 4,232,431 | A | 11/1980 | Akashi et al. | |
| 2005/0060848 | A1 | 3/2005 | Tsaur | |
| 2007/0017071 | A1 * | 1/2007 | Yokoyama et al. | 24/436 |

FOREIGN PATENT DOCUMENTS

| | | |
|---|---|---|
| CA | 1035120 | 7/1978 |
| EP | 0383603 | 8/1990 |
| EP | 1516553 | 3/2005 |
| EP | 1532887 | 5/2005 |
| TW | 564696 | 12/2003 |

* cited by examiner

*Primary Examiner* — Robert J Sandy
(74) *Attorney, Agent, or Firm* — Kilpatrick Townsend & Stockton LLP

(57) ABSTRACT

A top end stop is provided to adjoin a fastener element row, and a projecting portion is formed on an inner side face of a main body such that the projecting portion projects sideway, so as to form a concave portion in which a flange of a slider invades. A projecting piece thinner than the projecting portion is located in the concave portion such that the projecting piece extends from a contact face of the projecting portion to the inner side face of the main body in a triangular shape while its front end is inclined. Consequently, the flange presses the top end stop against a tape face by sliding of the slider, the top end stop itself is reinforced, the longitudinal pulling strength is improved, and a step between the main body and the projecting portion is smoothed, whereby a top end stop favorably tactile to the skin is produced.

2 Claims, 6 Drawing Sheets

SLIDE FASTENER TOP END STOP

INCORPORATION BY REFERENCE

The present application claims priority under 35 U.S.C. §119 to Japanese Patent Application No. 2006-355718 filed on Dec. 28, 2006. The entire contents of the application are incorporated herein by reference.

BACKGROUND OF THE INVENTION

1. Field of the Invention

The present invention relates to a top end stop of a slide fastener, and more particularly, to a slide fastener top end stop which is attached by injection molding means using synthetic resin such that the top end stop is continuous to fastener elements attached on one side edge of a fastener tape so as to stop a closing action of a fastener chain by a slider.

2. Description of Related Art

Conventionally, as shown in FIG. 9, a slide fastener top end stop 1' formed by injection molding means using resin such that the top end stop 1' adjoins an end portion of a fastener chain attached to one side edge of a fastener tape, on which fastener element row 5' formed continuously by winding resin made monofilament into a coil-like shape are attached by sewing with sewing thread is known according to Taiwanese Patent Application Publication No. 564696. This slide fastener top end stop 1' stops a slider 3' which slides on the fastener element row 5'. For this reason, a projection which the front end of a flange 27' of the slider 3' comes into contact with is formed so as to project in a transverse direction of the top end stop body 1'.

In the slide fastener top end stop 1' shown in FIG. 9, the top end stop 1' is formed on the surface of the fastener tape by injection molding means using synthetic resin such that the top end stop 1' adjoins coil-like continuous fastener element row 5' in a fastener chain in which the coil-like wound continuous fastener element row 5' are attached to one side edge of the surface of the fastener tape by sewing with sewing thread. In the top end stop 1', its projecting portion 13' is formed integrally on the top end of the main body such that the projecting portion 13' projects sideway. Thus, the projecting portion 13' needs to be formed in a large size to intensify the strength of the projecting portion 13' to prevent the projecting portion 13' from being broken when the flange 27' of the slider 3' strikes the projecting portion 13' so that the projecting portion 13' is pulled strongly.

SUMMARY OF THE INVENTION

The present invention has been achieved in considering the above-described problems, and a main object of the present invention is to provide a slide fastener top end stop which has a strength for protecting the top end stop from being damaged by resisting a pressing force from a slider when the slider strikes the top end stop as a result of sliding operation of the slider, namely, its longitudinal pulling strength by reinforcing the projecting portion formed on the top end stop and is capable of securing a predetermined strength even if the top end stop is reduced in size.

In addition, it is the object of the invention to provide a slide fastener top end stop which has a longitudinal pulling strength improved securely by reinforcing the projecting portion and ensures a favorable tactile feeling.

Further, it is another object of the invention to provide a slide fastener top end stop which can exert a stop function securely without projecting piece's interfering with a contact between the flange of the slider and the contact face of the projecting portion when the slider makes contact with the top end stop and stop the slider in a stabilized condition, the top end stop ensuring a favorably tactile feeling to the skin.

To achieve the above-described object, according to the invention, there is provided a top end stop made of resin and attached adjacent a top end of a fastener element row in a slide fastener, characterized by including: a main body having an outer side face opposing a diamond of a slider and an inner side face opposing a flange of the slider; and a projecting portion which projects sideway from the inner side face of the main body and can butt against the flange of the slider, a projecting piece thinner than the projecting portion is formed between the main body and the projecting portion.

Consequently, even if the top end stop is pulled strongly with the flange in contact with the projecting portion, the projecting portion is reinforced by the projecting piece. Accordingly, the projecting portion is protected from being damaged, and the slider can be prevented from slipping out from the top end of the fastener element row.

Preferably, the projecting piece is formed to extend from a proximal end of the projecting portion to its front end, and a front end of the projecting portion is connected with the inner side face of the main body.

Consequently, the projecting portion can be reinforced throughout an entire length of its projection by the projecting piece.

Further preferably, the projecting piece is formed such that its width dimension in the right-left direction is decreased gradually as it goes from the top end of the top end stop toward the bottom end side.

Consequently, a top end stop having favorable tactile feeling can be finished by connecting the front end of the projecting portion with the inner side face of the main body smoothly.

Further, it is preferable that when the flange of the slider butts against the projecting portion, the projecting piece is inserted into a tape groove formed along a side portion of the slider.

Consequently, the top end stop can stop the slider securely without interfering with a contact between the front end of the flange of the slider and the contact face of the projecting portion. As described above, the advantages which the present invention achieves are remarkable.

DESCRIPTION OF THE PREFERRED EMBODIMENTS

Figure 1:
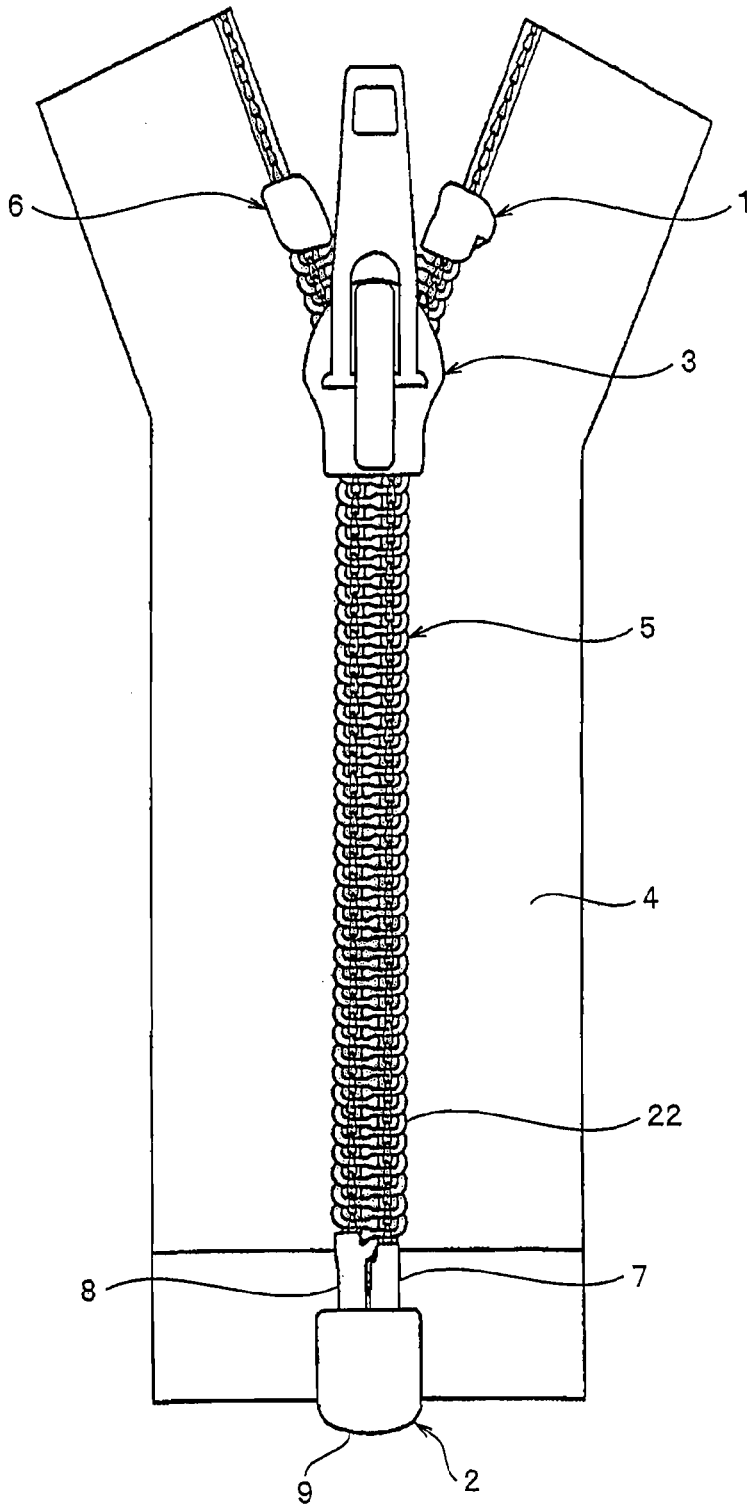
FIG. 1 is a front view of a slide fastener having a top end stop according to a first embodiment.

As for the configuration of a slide fastener top end stop of the present invention, continuous fastener element 22 are formed by winding polyamide or polyester monofilament into a coil-like shape as shown in FIG. 1. A core thread 20 is made to pass through the interior of the continuous fastener element 22. The continuous fastener element 22 are sewed each to side edges opposing each other of a fastener tape 4 with sewing yarn 21, whereby top end stops 1, 6 are formed by injection molding means using synthetic resin, for example, polyacetal such that the top end stops adjoin the continuous fastener element 22.

Of the right and left top end stops 1, 6, at least the top end stop 1 on one side is attached to the top end of the continuous fastener element 22 on a side in which a box pin 7 is injection molded such that the box pin 7 adjoins a bottom end of the continuous fastener element 22. Such a top end stop 1 comprises: a main body 10 composed of an outer side face 11 which opposes the side face of a diamond 28 of a slider 3 when the slider 3 comes into contact with the top end stop 1 and an inner side face 12 which is located on the opposite side to the outer side face 11, opposing the inner face of a flange 27 of the slider 3; and a projecting portion 13 which projects sideway from the top end side of the top end stop 1 on the inner side face 12 of the main body 10. The main body 10 and the projecting portion 13 have uninterrupted lubricate surface and are of substantially the same thickness. The projecting portion 13 has a contact face 16 which can make contact with the front end of the flange 27 of the slider 3, and the contact face 16 is arranged to intersect the inner side face 12 of the main body 10 substantially at right angle. Then, a concave portion 14 in which the flange 27 of the slider 3 can invade is formed between the contact face 16 and the inner side face 12, and a projecting piece 15 is formed in a smaller thickness than the main body 10 and the projecting portion 13 so as to connect the contact face 16 with the inner side face 12. The projecting piece 15 is formed from the proximal end of the projecting portion 13 to its front end, and has an inclined face 15*a* which connects the front end of the projecting portion 13 with the inner side face 12 at that front end. As a consequence, the projecting piece 15 is formed in a substantially triangular shape as seen in a plan view.

Figure 5:
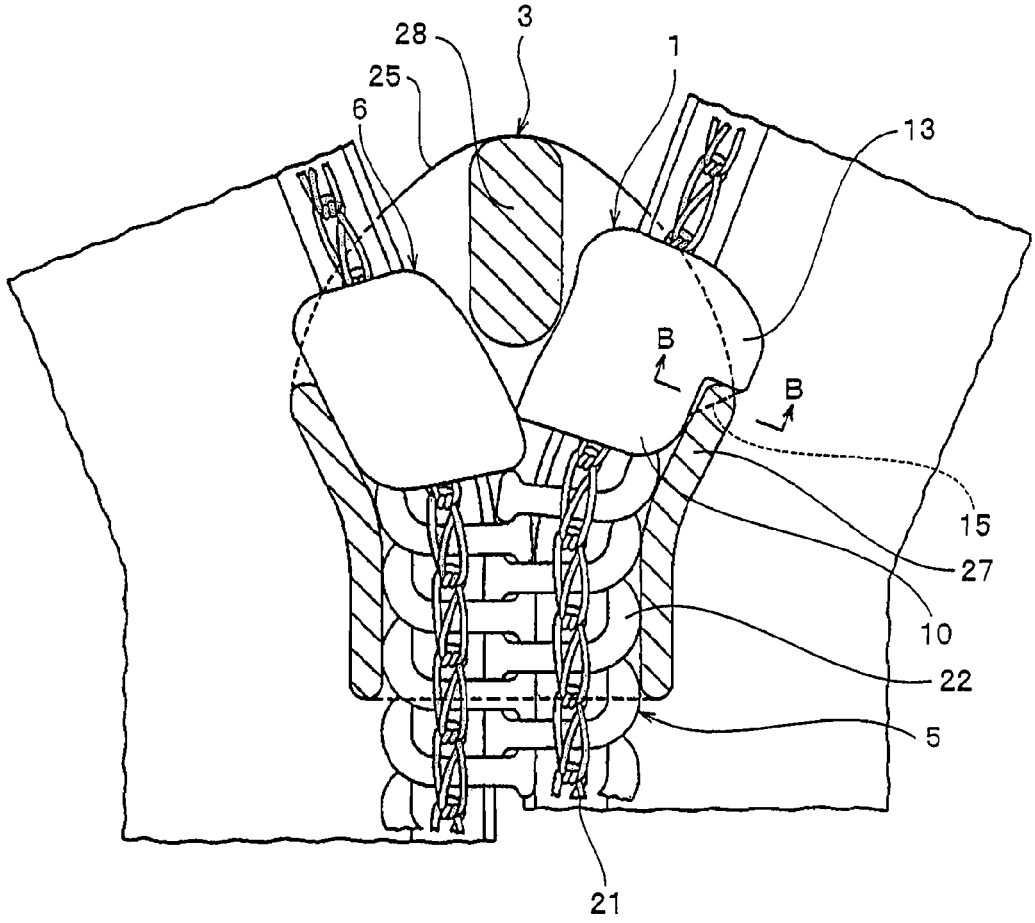
FIG. 5 is a front view showing the relationship between the top end stop and a slider.
Figure 6:
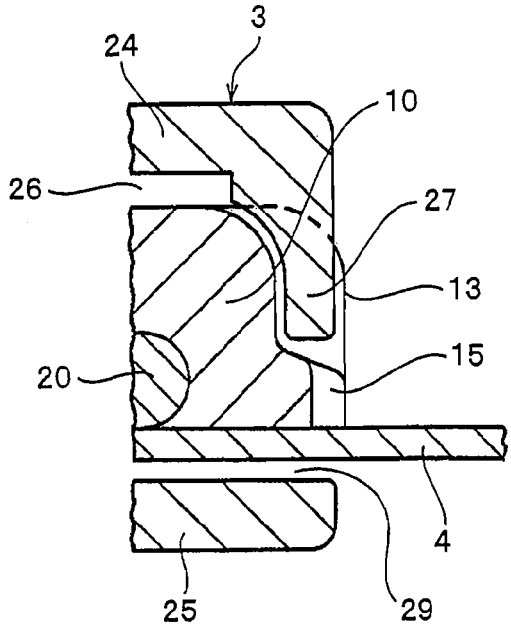
FIG. 6 is a sectional view of the top end stop taken along the line B-B in FIG. 5.

As shown in FIGS. 5 and 6, when right and left continuous fastener element 22 are engaged by sliding the slider 3 so that the flange 27 of the slider 3 comes into contact with the projecting portion 13 of the top end stop 1, the projecting piece 15 is inserted into a tape groove 29 formed along a side portion of the slider 3 thereby not interfering with a contact between the front end of the flange 27 and the contact face 16 of the projecting portion 13. The projecting piece 15 reinforces the projecting portion 13, so that when the flange 27 of the slider 3 and the projecting portion 13 of the top end stop 1 make contact with each other, the contact face 16 of the projecting portion 13 is never damaged even if it receives a strong pressing force from the slider 3. This allows to prevent the slider 3 from slipping out from the top end of the continuous fastener element 22. Further, the projecting piece 15 connects between the front end of the projecting portion 13 and the inner side face 12 of the main body 10 smoothly so as not to produce a step, thereby forming a top end stop favorably tactile to the skin.

First Embodiment

For the slide fastener top end stop of the first embodiment shown in FIGS. 1 to 6, a fastener element row 5 to be formed on a side edge of a fastener tape 4 is formed of a continuous fastener element 22, and the continuous fastener element 22 is formed by winding monofilament of synthetic resin such as polyamide or polyester into a coil-like configuration as shown in FIG. 1, or the continuous fastener element 22 is formed by bending the monofilament into a zigzag fashion and then bending at its center again. The continuous fastener element 22 is sewed to the surface on one side edge of a fastener tape 4 by double chain stitch using a sewing yarn 21 with a core thread 20 made to pass through or interposed in the interior of the continuous fastener element 22. Then, the top end stop 1 is injection-molded using synthetic resin such as polyacetal, polyamide, polypropylene, or polybutylene terephthalate so that the top end stop 1 adjoins the top end of the continuous fastener element 22. A box pin 7 is attached to the fastener tape 4 on one side such that the box pin adjoins the bottom end of the continuous fastener element 22, and an insert pin 8 is attached to the other fastener tape 4. Then, an opening device 2 constituted of a box 9 which the insert pin 8 can be inserted into/detached from is provided on the bottom of the box pin 7.

Figure 2:
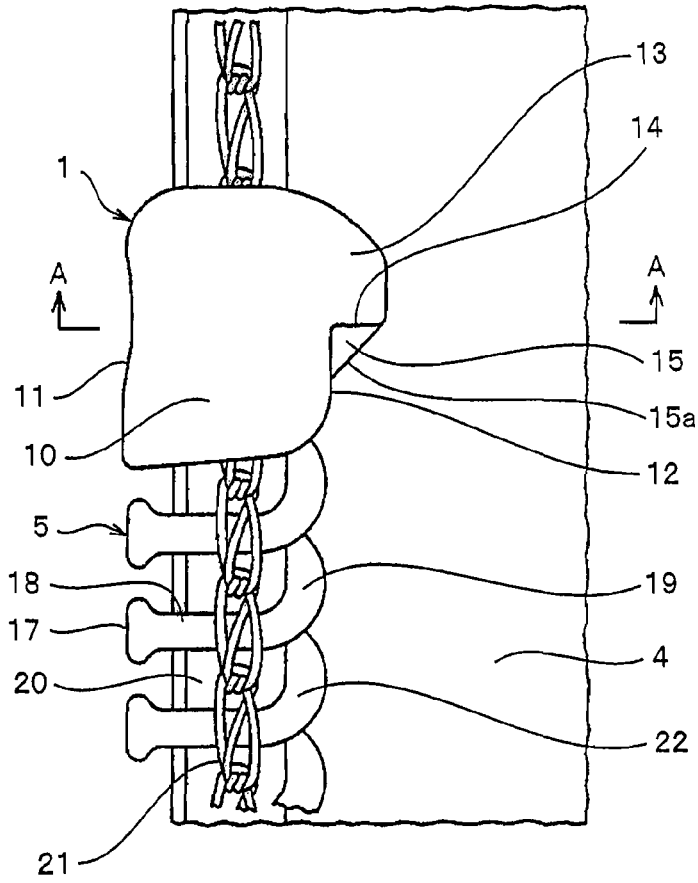
FIG. 2 is a front view of the top end stop.
Figure 3:
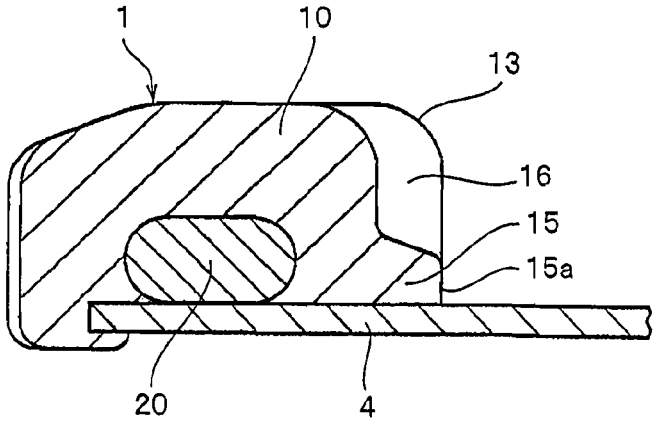
FIG. 3 is a sectional view of the top end stop taken along the line A-A in FIG. 2.
Figure 4:
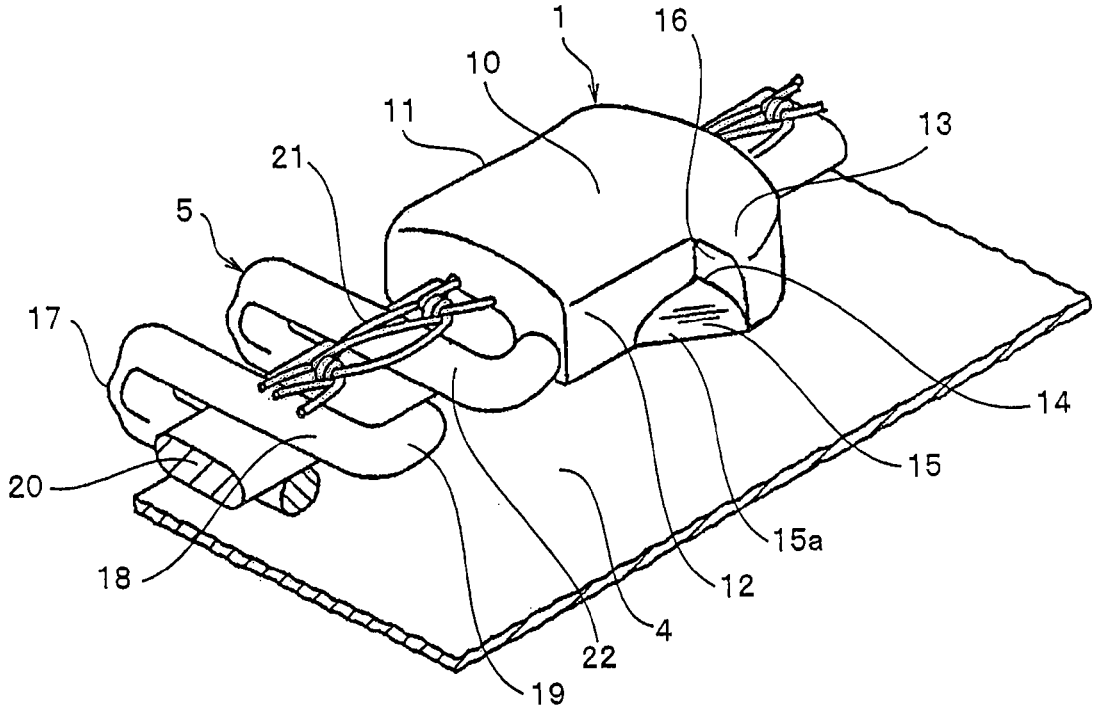
FIG. 4 is a perspective view of the top end stop.

As shown in FIGS. 2 to 4, the top end stop 1 covers the core thread 20 and the sewing yarn 21 and is formed on the rear side of the fastener tape 4 also across the side end face on one side edge of the fastener tape 4, thereby preventing the top end stop 1 from being separated from one side edge of the fastener tape 4. The main body 10 is arranged on the surface of the fastener tape 4 such that the main body adjoins the top end of the continuous fastener element 22. The main body 10 is comprised of an outer side face 11 which is located outside of the fastener tape 4 with respect to one side edge of the fastener tape 4 on which the continuous fastener element 22 is mounted and an inner side face 12 which is located on the opposite side to the outer side face 11 and inward of the fastener tape 4 with respect to the side edge of the fastener tape 4. A projecting portion 13 is formed on the top end side of the main body 10 of the inner side face 12 such that the projecting portion 13 projects sideway, that is, inward of the fastener tape 4.

The projecting portion 13 is formed in substantially the same thickness as the main body 10 in the front-rear surface direction of the top end stop 1, and a face located on the top end side of the top end stop 1 is formed into a curved face which is curved in an arc. A face located on the bottom end side of the top end stop 1 intersects the inner side face 12 of the main body 10 substantially at right angle so as to form a contact face 16 which is capable of making contact with the front end of the flange 27 of the slider 3. A concave portion 14 in which the flange 27 of the slider 3 can invade is formed between the main body 10 and the projecting portion 13, that is, between the inner side face 12 of the main body 10 and the contact face 16 of the projecting portion 13. A projecting piece 15 is provided in the concave portion 14 to connect the inner side face 12 with the contact face 16. The projecting piece 15 is formed in a smaller thickness than the projecting portion 13 in the front-rear surface direction of the top end stop 1 and arranged at a position in which it makes contact with the surface of the fastener tape 4. The width dimension in the right-left direction of the projecting piece 15 decreases gradually as it goes from the top end side to the bottom end side of the top end stop 1. Its front end face 15*a* is formed as an inclined face which is inclined downward while intersecting the contact face 16 and the inner side face 12. Further, the projecting piece 15 is formed from a proximal end of the projecting portion 13 to its front end, that is, throughout the entire width of the contact face 16 in the right-left width direction of the top end stop 1. Consequently, the projecting piece 15 reinforces the projecting portion 13 throughout the entire length in the projecting direction, connecting between the front end of the projecting portion 13 and the inner side face 12 of the main body 10, thereby eliminating a step between the main body 10 and the projecting portion 13 and providing an excellent tactile feeling.

The top end stop 1 may be brought into an element guide passage 26 inside the slider 3 by sliding the slider 3 in a direction of closing the fastener chain as shown in FIGS. 5 and 6. In this case, the diamond 28 which is formed in the center in the right-left direction of the element guide passage 26 and near the shoulder side of the slider 3 opposes the outer side face 11 of the main body 10 of the top end stop 1, and the flanges 27 which are formed on both sides in the right-left direction of the element guide passage 26 and near the rear mouth of the slider 3 opposes the inner side face 12 of the main body 10 of the top end stop 1. A tape groove 29, which communicates with the element guide passage 26 and is capable of inserting the fastener tape 4, is formed in the right and left side portions of the slider 3. At this time, the projecting piece 15 is inserted into the tape groove 29 which is formed between each of the flanges 27 arranged on both sides of an upper blade plate 24 of the slider 3 such that they project and a lower blade plate 25 of the slider 3 so that the fastener tape 4 can be inserted therein, while avoiding a contact with the front end of the flange 27. Consequently, the front end of the flange 27 makes contact with the contact face 16 of the projecting portion 13. In the meantime, the flange 27 is not limited to a type in which it projects from the upper blade plate 24, but may be of type in which it projects from the lower blade plate 25. In this case, the top end stop 1 and the continuous fastener element 22 are attached to the rear face side of the fastener tape 4, and the tape groove 29 is formed between the flange 27 and the upper blade plate 24.

Figure 7:
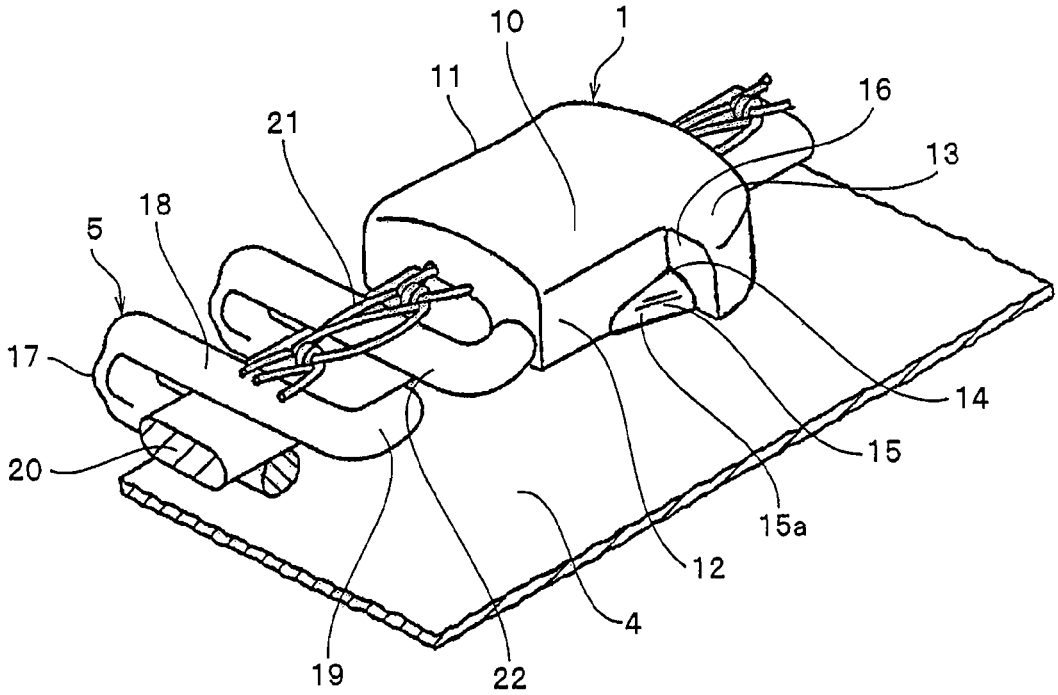
FIG. 7 is a perspective view showing a modification of the top end stop.

A slide fastener top end stop shown in FIG. 7 indicates a modification of the top end stop 1. The projecting piece 15, which is thicker than the triangular projecting portion 13 in a plan view, is provided in the concave portion 14 between the inner side face 12 of the main body 10 and the contact face 16 of the projecting portion 13 obliquely from a position slightly apart from the front end of the projecting portion 13 toward the proximal end side. The function of the projecting piece 15 is the same as in the above example, and this embodiment can be applied as a large size top end stop 1.

Second Embodiment

Figure 8:
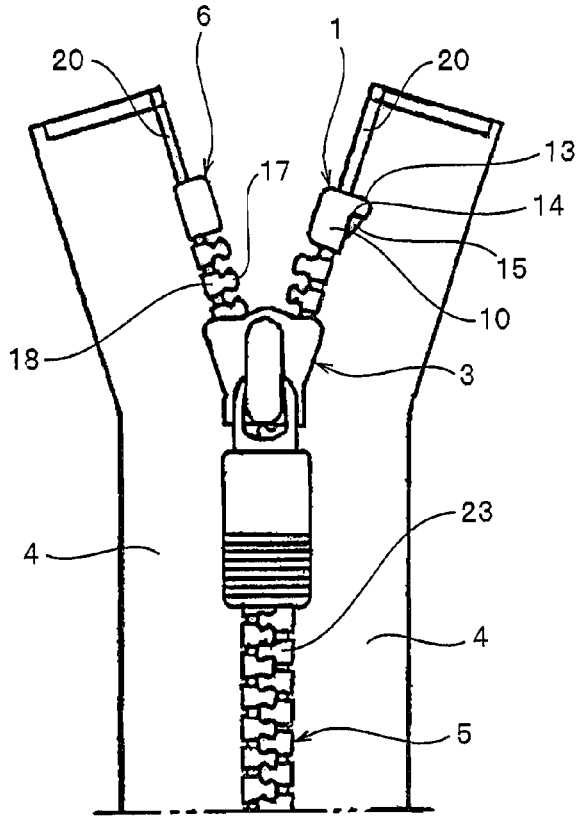
FIG. 8 is a front view showing part of a slide fastener having a top end stop according to a second embodiment.
Figure 9:
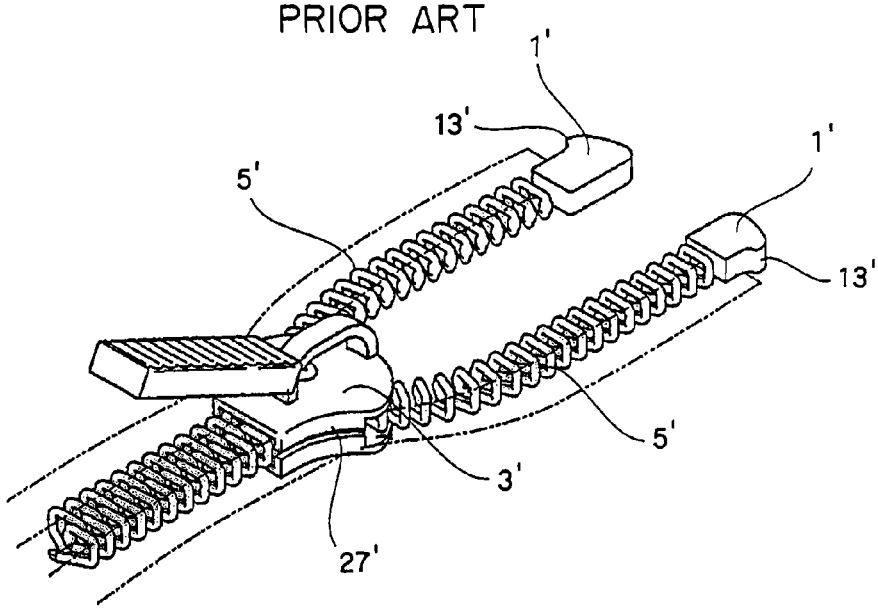
FIG. 9 PRIOR ART
FIG. 9 is a perspective view showing part of a slide fastener having a known top end stop.

In a slide fastener top end stop of a second embodiment shown in FIG. 8, a fastener element row 5 to be formed on a side edge of a fastener tape 4 are formed of single body fastener elements 23, and the single body fastener elements 23 are molded on the front and rear faces of the fastener tape 4 by injection molding means using synthetic resin such as polyacetal, polyamide, polypropylene, or polybutylene terephthalate. The single body fastener elements 23 is comprised of a coupling head 17 and leg portions 18, and the leg portions 18 are arranged on the front and rear sides of the fastener tape 4. In the meantime, a core thread 20 is arranged on a side edge of the fastener tape 4, and the single body fastener elements 23 are injection molded on the core thread 20.

The top end stop 1 is injection molded using the same synthetic resin as the single body fastener elements 23 such that the top end stop 1 adjoins the single body fastener elements 23. The main body 10 is comprised of an outer side face 11 located outside of the fastener tape 4 and an inner side face 12 which is located on the opposite side to the outer side face 11 and inside of the fastener tape 4. A projecting portion 13 having the same thickness as the main body 10 and projecting inward of the fastener tape 4, is formed at the top end of the inner side face 12 of the main body 10. A projecting piece 15 thinner than the projecting portion 13 is provided in a concave portion 14 formed on the main body 10 and at the proximal end of the projecting portion 13 such that the projecting piece 15 extends from the front end of the projecting portion 13 to the inner side face 12 of the main body 10. The projecting piece 15 is capable of inserting into the tape groove 29 formed between the flanges 27 provided on both sides of the upper and lower blade plates of the slider 3.

A large advantage of installing the projecting piece 15 on the main body 10 is that when a flange 27 of the slider 3 strikes the projecting portion 13 of the top end stop 1, the projecting piece 15 provided in the concave portion 14 prevents the projecting portion 13 from being damaged by a pressing against the projecting portion 13, in order to prevent the slider 3 from slipping out from the fastener element row 5.

In the fastener stringer having the slider fastener top end stop of the present invention, the projecting portion which is provided on the top end stop main body to exert a function of stopping the slider has a strength for protecting itself from damage when the projecting portion strikes the slider. Consequently, the slider is prevented from slipping out, and a top end stop favorably tactile to the skin can be produced.

What is claimed is:

1. A slide fastener comprising:

a pair of slide fastener top end stops made of resin, each top end stop attached adjacent a top end of a fastener element row;

a slider, which is attached to opposing side edges of a pair of fastener tapes and which slides along each of the fastener element rows so as to be capable of engaging and releasing the fastener elements, the slider having:

a diamond connecting upper and lower blade plates of the slider;

a flange disposed from each of right and left side edges of the upper blade plate toward the lower blade plate;

at least one of the top end stops including a main body comprising an outer side face opposing the diamond of the slider and an inner side face opposing the flange of the slider, a projecting portion projecting sideways from the inner side face on an end portion on the opposite side to the fastener elements of the main body, which is capable of butting against a side end face of the top end of the flange of the slider, and a projecting piece disposed between the main body and the projecting portion; and wherein the projecting piece is formed from a proximal end on a side of the main body of the projecting portion to a front end thereof so that the front end of the projecting portion is connected with the inner side face of the main body; and wherein the projecting piece is thinner than the projecting portion in a direction perpendicular to a tape face of the fastener tape and that a dimension of the projecting piece in the width direction of the fastener tape is decreased gradually as it goes from a side of the projecting portion to a side of the main body.

2. The slide fastener according to claim 1, wherein when the flange of the slider butts against the projecting portion, the projecting piece is inserted into a tape groove formed between the flange and the lower blade plate.

* * * * *